US007163210B1

(12) United States Patent
Rehkemper et al.

(10) Patent No.: US 7,163,210 B1
(45) Date of Patent: Jan. 16, 2007

(54) TRAINING DEVICE FOR WHEELED VEHICLES

(75) Inventors: Steven Rehkemper, Chicago, IL (US); Jeffrey Rehkemper, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 191 days.

(21) Appl. No.: 10/746,489

(22) Filed: Dec. 29, 2003

(51) Int. Cl.
*A63C 17/12* (2006.01)

(52) U.S. Cl. ..... 280/11.27; 280/11.221; 280/11.223

(58) Field of Classification Search ..... 280/11.201, 280/11.205, 11.221, 11.223, 11.27; 301/5.301, 301/5.305
See application file for complete search history.

(56) References Cited

U.S. PATENT DOCUMENTS 4,272,094 A * 6/1981 Patrin ..... 280/217
4,553,767 A * 11/1985 Robjent et al. ..... 280/11.201
4,595,209 A * 6/1986 Tsai ..... 280/11.115
RE32,346 E * 2/1987 Klamer et al. ..... 280/11.201
4,932,676 A * 6/1990 Klamer ..... 280/11.201
5,192,099 A * 3/1993 Riutta ..... 280/11.201
5,362,081 A * 11/1994 Beidler et al. ..... 280/250.1
5,630,596 A * 5/1997 Rudolph ..... 280/11.214
5,704,618 A * 1/1998 Sfoggia ..... 280/11.214
5,709,395 A * 1/1998 Lee ..... 280/11.204
5,826,897 A * 10/1998 Beard ..... 280/250.1
5,829,756 A * 11/1998 Mitchell et al. ..... 280/11.214

* cited by examiner

*Primary Examiner*—Jeff Restifo

(57) ABSTRACT

In accordance with one embodiment of the present invention there is provided a vehicle with a training device for use on a skateboard. The training device includes an assembly disposed about one of a plurality of axles of the skateboard. The assembly has a transfer gear horizontally moveably to a first position to engage a flywheel wheel to provide resistance to the skateboard and to charge the flywheel when a wheel corresponding to one of the plurality of axles spins, such that when the flywheel is charged the flywheel provides inertia to the wheel. The training device may also be designed to be entirely incorporated with a single wheel for use with in-line skate or scooters. In either embodiments the training device includes the ability to have more resistance when the wheels first begin to rotate (as the user first begins to ride the vehicle), a continual reduction in resistance as the wheels begin to rotate faster, and a build up of inertia during use such that when the user pauses, the inertia continues to rotate the wheels.

3 Claims, 5 Drawing Sheets

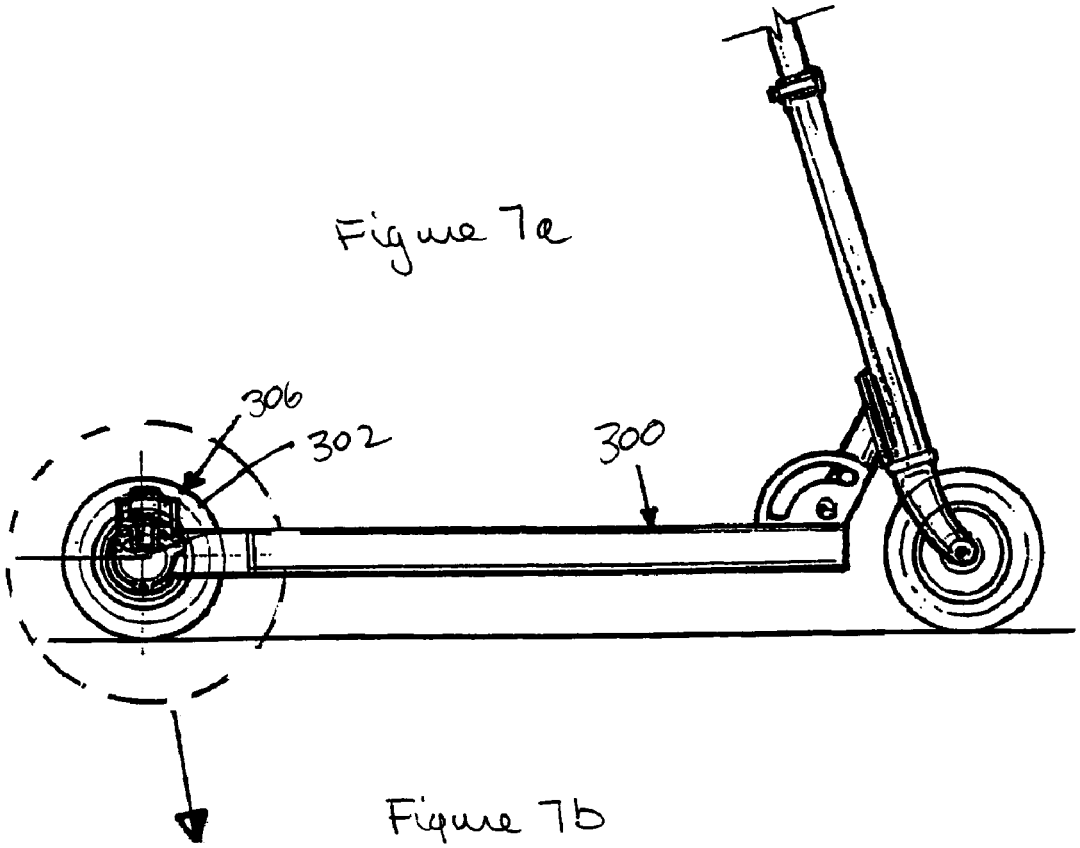
Figure 7a
Figure 7b
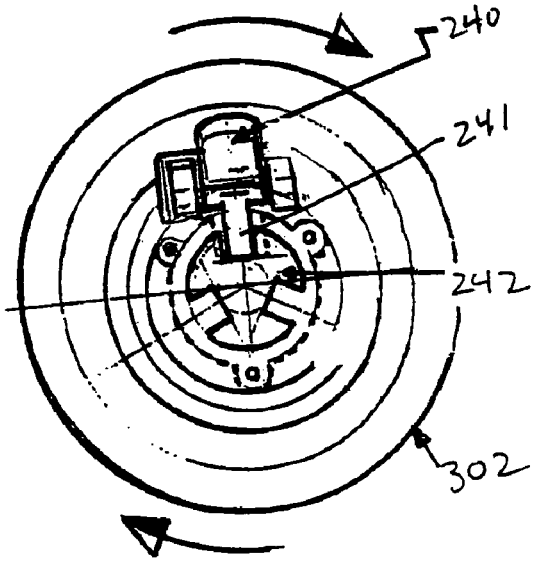

TRAINING DEVICE FOR WHEELED VEHICLES

FIELD OF THE INVENTION

The present invention relates to wheeled vehicles (such as skateboards, in-line skates, scooters, etc.) and more specifically to a training device for these vehicles.

BACKGROUND OF THE INVENTION

Skateboards, in-line skates, scooters and other wheeled vehicles, are extremely popular with children and young adults. Beginners, however, have a difficult time learning to use these vehicles because the wheels and bearings are capable of spinning quickly at all times, which allows the user to travel at high speeds with little effort. Many beginners find it difficult to maintain balance because the wheels travel faster then their body can adjust and as a result the vehicle often moves out from underneath the user. The potential for injury is extremely great for a beginner until the user becomes comfortable with using the vehicle. Other patents have tried to address this problem with cumbersome mechanisms and resistance devices, such as U.S. Pat. Nos. 6,003,881 and 6,131,921 owed by Reebok International Ltd. In addition, these patents do not provide the user with the ability to have more resistance when the wheels first begin to rotate (as the user first begins to ride the vehicle), a continual reduction in resistance as the wheels begin to rotate faster, and a build up of inertia during use such that when the user pauses, the inertia continues to rotate the wheels.

SUMMARY OF THE INVENTION

In one embodiment of the present invention there is provided a vehicle with a training device for use on a skateboard. The training device includes an assembly disposed about one of a plurality of axles of the skateboard. The assembly has a transfer gear horizontally moveable to a first position to engage a flywheel wheel that provides resistance to the skateboard and charges the flywheel. When the flywheel is charged, the flywheel is able to provide inertia to the wheel corresponding to one of the plurality of axles. The training device may also include a wheel gear train secured to the wheel and a transfer gear secured to the wheel gear train such that when the wheel rotates, the transfer gear rotates. The transfer gear is also slidably mounted on a transfer axle which permits horizontal movement of the transfer gear to and from an engagement position and a disengagement position. The training device also includes a drive train secured to a flywheel, the drive train meshes with the transfer gear when the transfer gear is horizontally moved to the engagement position. As mentioned above, when the flywheel is engaged, the flywheel adds resistance to the wheel providing a user with stability. As the flywheel continually rotates, it builds and stores inertia energy that can be used to help sustain the rotational speed of the wheel when the user is no longer forcing the wheel to rotate.

In a second embodiment, a training device is fully incorporated into a wheel that may be utilized by in-line skates and scooters.

Numerous other advantages and features of the invention will become readily apparent from the following detailed description of the invention and the embodiments thereof, from the claims, and from the accompanying drawings.

Brief Description of the Drawings

A fuller understanding of the foregoing may be had by reference to the accompanying drawings, wherein:

FIG. 7*a* is an illustration of the second embodiment of the resistance training device shown in use with a scooter; and FIG. 7*b* is an close-up illustration of the wheel from FIG. 7*a* showing a locking mechanism.

DETAILED DESCRIPTION OF THE DRAWINGS

Figure 1:
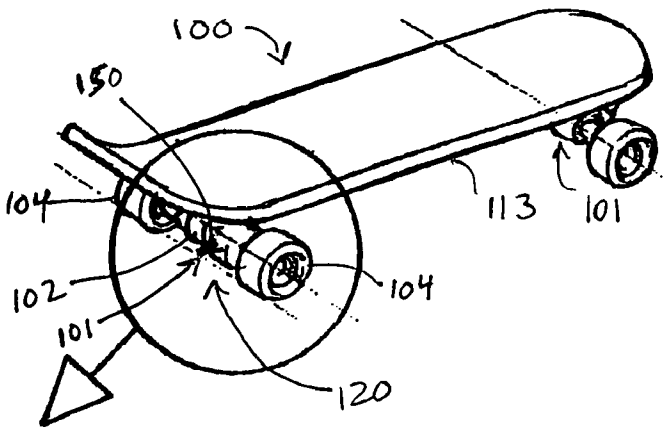
FIG. 1 is an illustration of a skateboard with a training device in accordance with a first embodiment of the invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, there is shown a first embodiment of the present invention that includes a wheeled vehicle, namely a skateboard 100 that includes a training device 120 secured along a rear axle 102 defined by the skateboard 100. The axle 102 is typically split to provide for independent rotation of the two rear wheels 104. The training device 120 is designed to provide resistance to the wheel that it is attached to, when the wheel first begins to rotate. The vehicle is thus more stable and easier to mount because the vehicle is not completely freely able to move out from underneath the user. As the user rotates the wheels faster and faster, the resistance that the training device is exhibiting onto the wheel continues to reduce. At the same time, the training device 120 begins to charge and store inertia energy. When the user pauses or stops forcing the wheels to spin, the training device begins to utilize the stored inertia energy to continue to spin the wheels at a higher rate than the momentum built up by the moving vehicle, such that the wheeled vehicle will sustain and maintain a speed in a more controlled fashion than when freely able to move. If the user begins to rotate the wheels again, the training device 120 repeats the above and begins to recharge.

Figure 2:
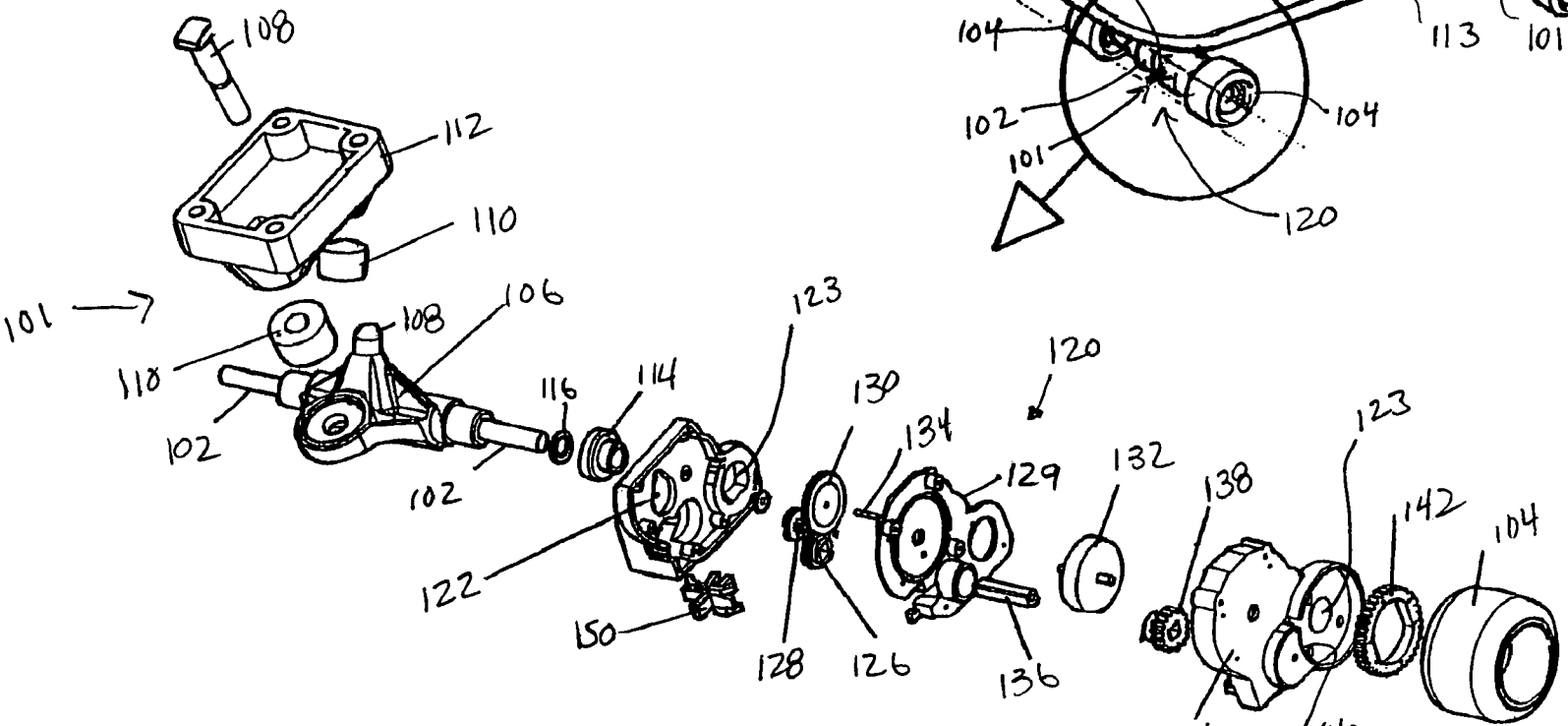
FIG. 2 is an exploded view of the training device in accordance with a first embodiment of the invention.

Referring now to FIG. 2, the training device 120 is secured about one of the two wheel assemblies 101 that is mounted to the deck 113 of the skateboard 100. Preferably the training device 120 is secured about an axle 102, which is attached to an axle mount 106. The axle mount 106 is attached by a pair of pins 108, through bushings 110, to an axle mount plate 112. The axle mount plate 112 is fastened to the deck 113 of the skateboard 100. Mounted on the axle 102 between the training device 120 and the axle mount 106 is a wheel bearing 114 and a o-ring 116. The axle 102 extends through the training device 120 and a wheel 104 is attached thereto such that the wheel 104 is capable of spinning freely about the axle 102.

The training device 120 has an inside housing section 122 that is connected to an outside housing section 124. The two piece housing sections 122 and 124 when assembled include an axle opening 123 in order to permit the axle 102 to extend therethrough to the wheel 104.

Rotatably connected to the inside housing section 122 is a drive train defined by a transfer gear 126 that is selectively and slidably engaged with a combo gear 128 that is further meshed to a flywheel gear 130. The drive train is rotatably attached to one side of a drive train plate 129 that is positioned within the two piece housing sections 122 and 124. More specifically, the flywheel gear 130 is mounted on a flywheel axle 134 that passes through the drive train plate 129 while, the combo gear 128 is freely rotatably secured to the drive train plate 129. Rotatably attached to the other side of the drive train plate 129 is a flywheel 132, which is mounted on the flywheel axle 134, such that when the flywheel gear rotates, the flywheel 132 rotates and vice-versa.

The transfer gear 126 is slidably mounted, in the horizontal direction, on a transfer axle 136. The transfer gear 126 is moved by horizontally moving a lever 150 that is accessible by the user on the outside of or externally to the training device 120. The transfer axle 136 also accommodates a gear 138 that is meshed through an opening 140 on the outside housing section 124 to a wheel gear 142. (The gear 138 and the wheel gear 142 are also defined as the wheel gear train.) The wheel gear 142 is secured to the wheel 104, such that when the wheel rotates the wheel gear train rotates and visa-versa.

Figure 4:
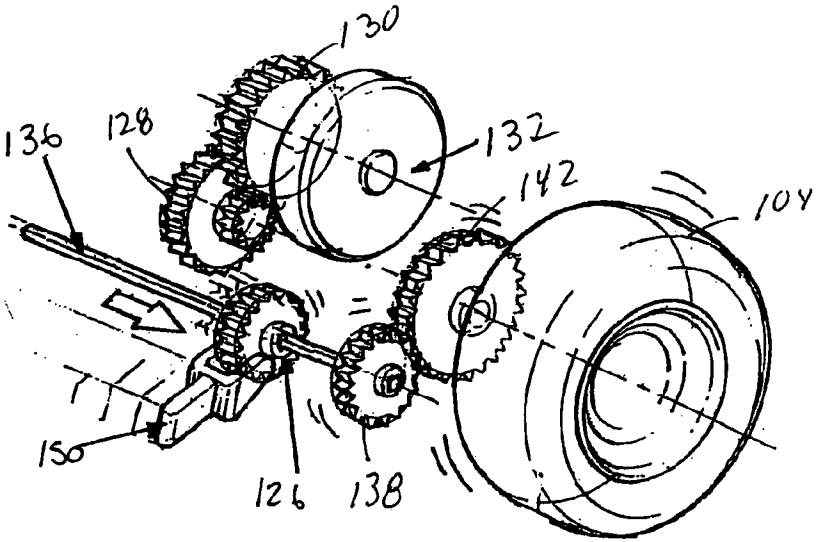
FIG. 4 is an illustration of the gear train assembly utilized in the training device when the training device is disengaged.
Figure 3:
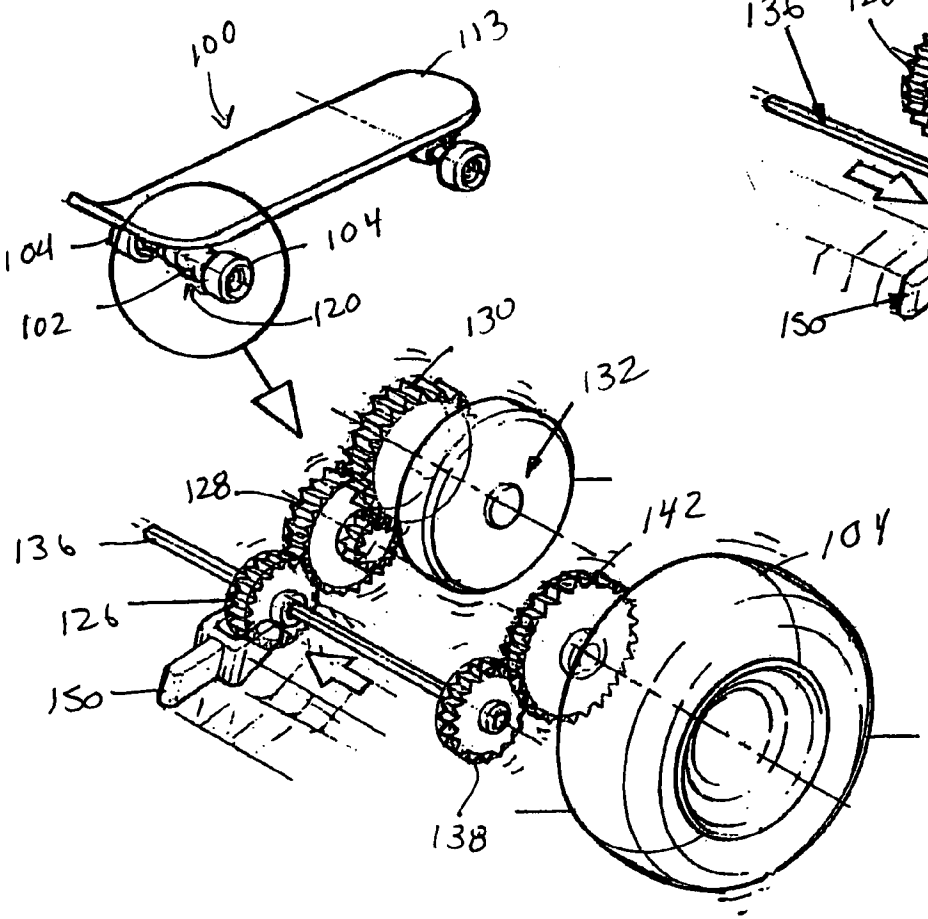
FIG. 3 is an illustration of the gear train assembly utilized in the training device when the training device is engaged.

Referring now to FIGS. 3 and 4, in order to engage the training device 120 the user slides lever 150 horizontally such that the transfer gear 126 meshes with the combo gear 128. In this "engagement position" the rotation of the wheel 104 causes the flywheel 132 to rotate and vice versa. The flywheel 132 initially places resistance onto the wheel 104 such that the skateboard 100 is more stable and easier to mount. The flywheel 132 also charges during use such that when the user pauses (temporarily stops forcing the vehicle forward but does not actually stop the vehicle from moving), inertia in the flywheel helps sustain and maintain the current speed. As the user becomes more experienced with the vehicle the training device 120 can be disabled or disengaged by horizontally sliding the lever 150 such that the transfer gear is no longer meshed with the combo gear 128. In the disengagement position the wheel 104 does not rotate the flywheel 133 and thus there is no resistance and no build up of inertia.

It is further noted that the training device 120 is not engaged or disengaged during use. The user must engage or disengage the training device 120 prior to using the skateboard. Because access to the training device 120 is under the deck 113 of the skateboard.

Figure 5:
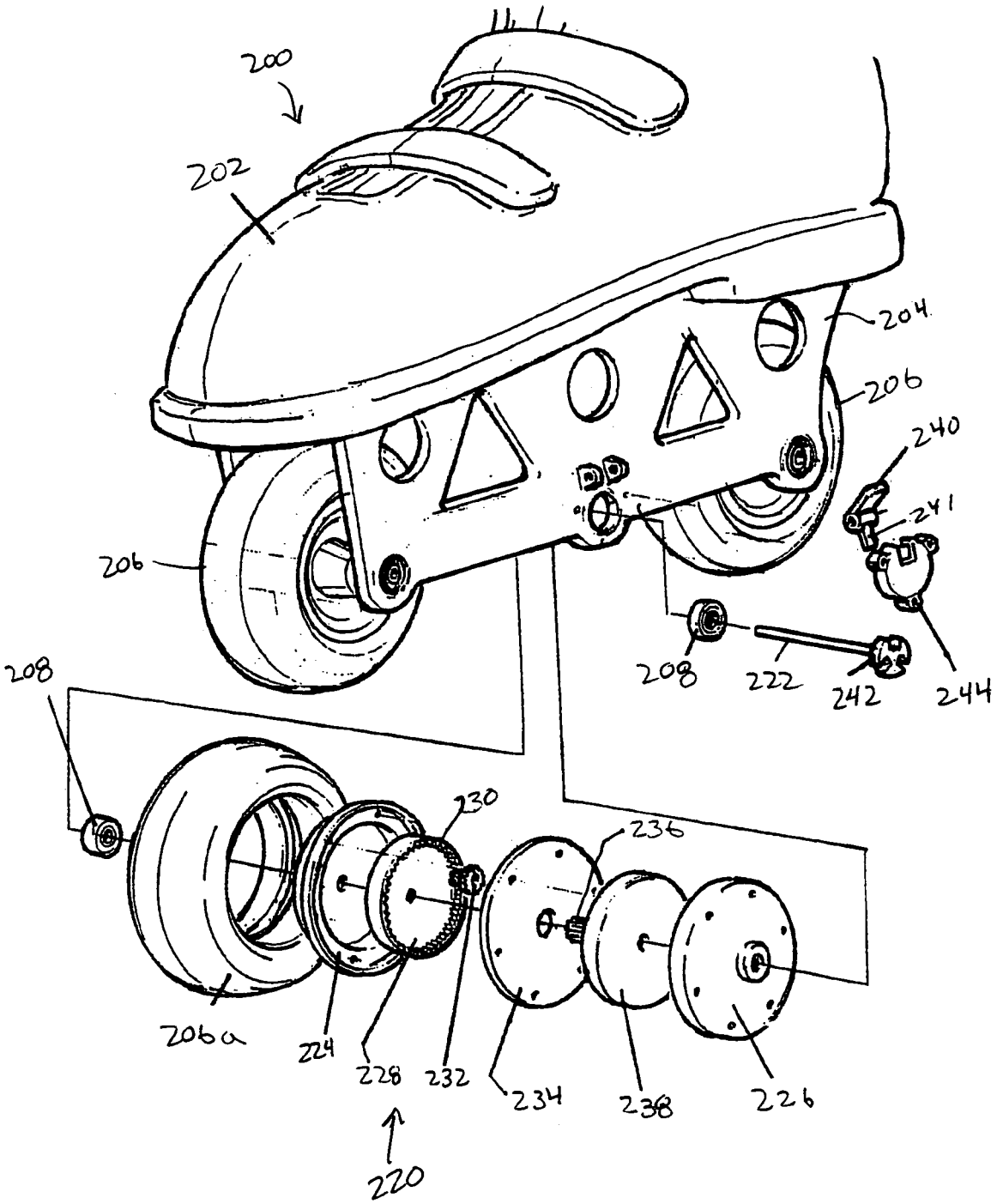
FIG. 5 is an illustration with a partial exploded view of a second embodiment of the resistance training device shown in use with an in-line skate.
Figure 6:
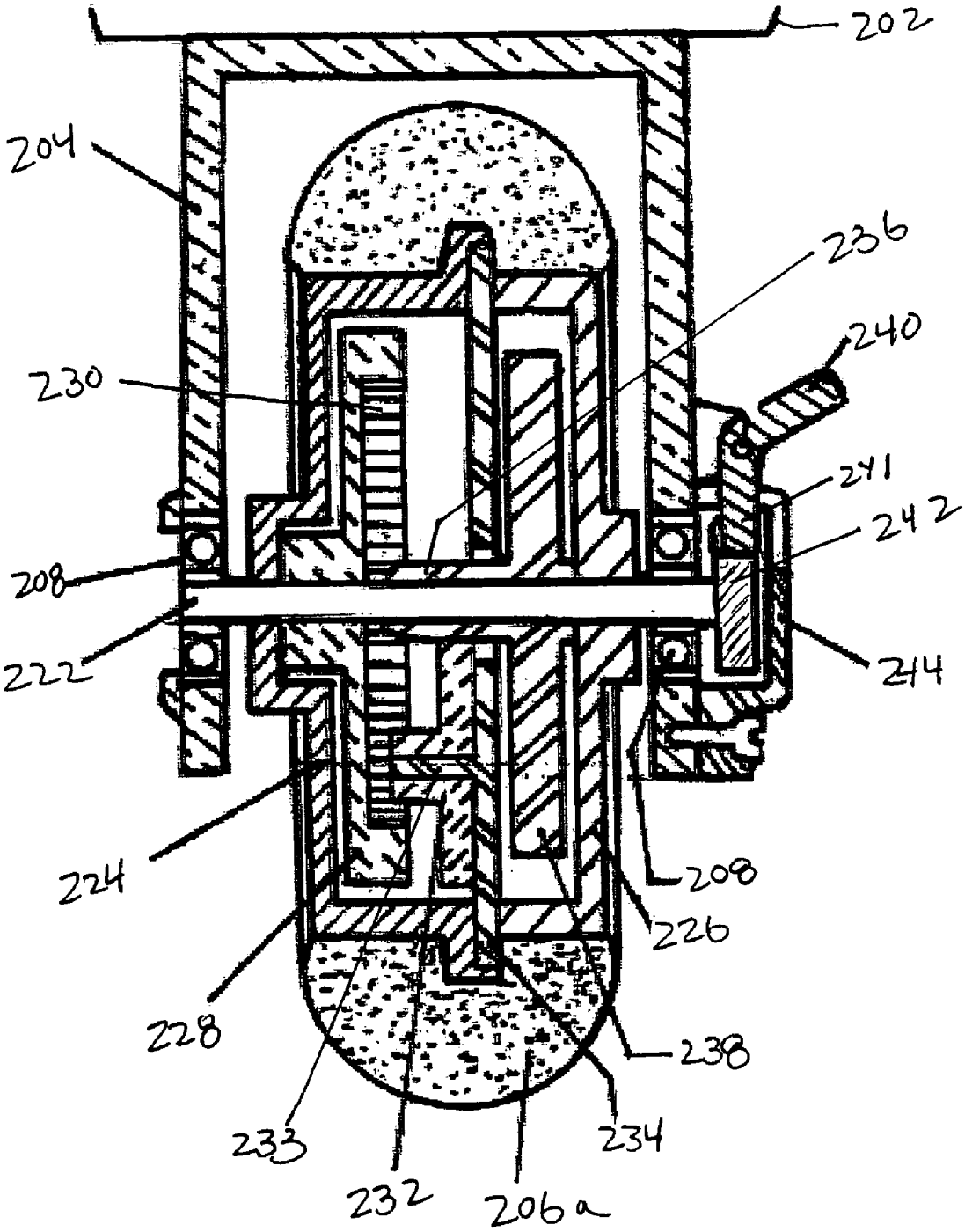
FIG. 6 is a cross section view of the second embodiment of the resistance training device illustrated in FIG. 5.

Referring now to FIGS. 5 and 6, in a second embodiment of the present invention a training device is contained within a single wheel that is secured to a wheeled vehicle. In this embodiment, the wheeled vehicle is an in-line skate 200 that includes a boot 202 secured to a chassis 204. A plurality of wheels 206 are rotatably disposed to the chassis 204 by sealed wheel bearings 208. One of the wheels 206*a* contains a training device 220 in accordance with a second embodiment of the present invention. While it is shown that the in-line skate 200 includes three wheels 206 with the center wheel 206*a* having the training device 220 incorporated therein, the invention may incorporate more or less than three wheels and include more than one training device; moreover the placement of the training device (being illustrated in the intermediate wheel) may be changed.

The wheel 206*a* along with the training device 220 spin about an axle 222 that is positioned through the sealed wheel bearings 208. The training device 220 includes a first wheel housing 224 and a second wheel housing 226 which form the outer housing of the training device 220. Both the first and second wheel housings 224 and 226 are secured to the wheel 206*a* and therefore, spin with the wheel 206*a*; in other words the first wheel housing 224 and second wheel housing 226 can freely spin about the axle 222 Rotatably received within the first wheel housing 224 is an internal gear 228 that is fixed on the axle 222. The internal gear 228 includes an internal annular rack 230 that meshes with a combo planetary gear 232. The combo planetary gear 232 spins about a pin 233 extending out of a gear plate 234 which is fixed to the first and second wheel housings 224 and 226. The combo planetary gear 232 is positioned such that it is both meshed with the internal annular rack 230 of the internal gear 228 and meshed with a centered pinion 236 defined on a flywheel 238. The centered pinion 236 and flywheel 238 is capable of freely spinning about the axle 222. Lastly, the axle 222 is capable of being locked in place by a locking lever 240 that when pushed downwardly secures a cam 242 that is fixed to the axle 222. A locking cover 244 is also provided to protect the locking lever or mechanism.

During operation, the in-line skate with training device has two modes: a free spinning mode and a resistance training mode. In the resistance training mode, the locking mechanism is locked, meaning the locking lever 240 is pushed downwardly securing the cam 242 and thus securing the axle 222 in a fixed position. As the user begins to use the in-line skates, the internal gear 224 being fixed to the axle 222 will not rotate. Since the gear plate 234 is rotating with the wheel 206*a* (by virtue of being fixed to the first and second wheel housings 224 and 226), the combo planetary gear 228 is rotating therewith. The combo planetary gear 228 is also spinning about the pin 233 because it is meshed with the annular rack 230 of the internal gear 228 which is fixed to a non-spinning axle 222. The combo planetary gear 228 will, therefore, cause the centered pinion 236 to spin which causes the flywheel 238 to spin and build up or store inertia energy. At the beginning the flywheel 238 will add resistance to the wheel 206*a* until the user begins to go faster and faster, building up inertia and reducing the resistance, when the user pauses (as defined above), the flywheel 238 will begin to use up its inertia causing the wheel 206*a* to rotate longer.

In the free spinning mode, the locking mechanism is unlocked, meaning the locking lever 240 is pulled upwardly allowing the axle 242 to spin with the wheel 206*a*. As such, the entire training device 220 is rotating with the axle (the gear plate 234 and the internal gear 228 are rotating together) and therefore no resistance is initially applied to the wheel 206*a* by the flywheel 238 nor is the flywheel 238 storing energy.

Referring now to FIG. 7*a* the training device discussed with respect to the in-line skate may be applied to a scooter 300. As illustrated more closely in FIG. 7*b*, the scooter 300 includes a wheel 302 with a training device incorporated therein. A locking mechanism 306, as previously disclosed, includes a locking lever 240 with an arm 241 that secures the cam 242 in place.

From the foregoing and as mentioned above, it will be observed that numerous variations and modifications may be effected without departing from the spirit and scope of the novel concept of the invention. It is to be understood that no limitation with respect to the specific methods and/or apparatus illustrated herein is intended or should be inferred. It is, of course, intended to cover by the appended claims all such modifications as fall within the scope of the claims.

We claim:

1. A training wheel that is able to spin freely about an axle for use on a balanced vehicle, the training wheel comprising:

a two piece wheel housing that rotates freely about said axle;

an internal gear being freely rotatably mounted within the wheel housing and being fixed on said axle of the vehicle and, the internal gear having an internal annular rack;

a planetary gear meshed to said annular rack;

a gear plate secured to said planetary gear and secured between edges defined by said two piece wheel housing;

a flywheel having a centered pinion, the flywheel being freely rotatably mounted on said axle and said pinion having an outer region meshed with the planetary gear; and a cam secured to one end of said axle; and a locking lever with an arm, the locking lever moveably secured to said vehicle such that when positioned in a locking position said arm engages said cam to prevent rotation of said axle and when said locking level is positioned in an unlocking position said arm is not engaged with said cam and said axle rotates with the rotation of said wheel.

2. The training wheel of claim 1, wherein the vehicle is an in-line skate.

3. The training wheel of claim 1, wherein the vehicle is a scooter.

* * * * *